US010197294B2

(12) United States Patent
Eskew et al.

(10) Patent No.: US 10,197,294 B2
(45) Date of Patent: Feb. 5, 2019

(54) FOAM SUBSTRUCTURE FOR A HEAT EXCHANGER

(71) Applicant: Johnson Controls Technology Company, Plymouth, MI (US)

(72) Inventors: Robert L. Eskew, Kingman, KS (US); Frank D. Ashby, Wichita, KS (US); Jeremiah M. Horn, Derby, KS (US); Cody J. Kaiser, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 15/398,605

(22) Filed: Jan. 4, 2017

(65) Prior Publication Data

US 2017/0205084 A1 Jul. 20, 2017

Related U.S. Application Data

(60) Provisional application No. 62/279,277, filed on Jan. 15, 2016.

(51) Int. Cl.
*F24F 1/56* (2011.01)
*F24F 1/16* (2011.01)
*F24F 1/50* (2011.01)

(52) U.S. Cl.
CPC ..... *F24F 1/16* (2013.01); *F24F 1/50* (2013.01); *F24F 1/56* (2013.01)

(58) Field of Classification Search
CPC ..... F24F 1/16; F24F 13/08; F24F 1/50; F24F 1/56; F24F 13/20; F24F 13/082; F24F 3/14; F24F 3/16
USPC ..... 62/506, 507; 165/58
See application file for complete search history.

(56) References Cited

U.S. PATENT DOCUMENTS

| | | | | |
|---|---|---|---|---|
| 3,321,931 A | | 5/1967 | Lehmkuhl | |
| 3,799,128 A | | 3/1974 | Small | |
| 4,018,297 A | | 4/1977 | Haupt | |
| 4,140,433 A | | 2/1979 | Eckel | |
| 4,191,245 A | | 3/1980 | Wendt et al. | |
| 4,202,409 A | * | 5/1980 | Cann | F24F 1/14 165/122 |
| 4,307,778 A | | 12/1981 | Tobin et al. | |

(Continued)

FOREIGN PATENT DOCUMENTS

| | | | | |
|---|---|---|---|---|
| JP | H11218023 A | | 8/1999 | |
| KR | 2003057023 | * | 7/2003 | F24F 5/00 |

(Continued)

OTHER PUBLICATIONS

Abstract of 2003057023 of Choie et al.*

(Continued)

*Primary Examiner* — David Teitelbaum
(74) *Attorney, Agent, or Firm* — Fletcher Yoder, P.C.

(57) ABSTRACT

A heat exchanger system includes a heat exchanger coil, a base of a foam structure including a clamp with a first arm and a second arm, where the first arm and the second arm are configured to exert a clamping force against the heat exchanger coil, and a vertical member of the foam substructure coupled to the base and abutting a cover of the heat exchanger system, where the base and the vertical member are configured to block air flowing through the heat exchanger from flowing into a void between the heat exchanger coil and the cover.

9 Claims, 9 Drawing Sheets

(56) References Cited

U.S. PATENT DOCUMENTS

| | | | | |
|---|---|---|---|---|
| 4,391,322 | A | 7/1983 | Ciarlei et al. | |
| 4,454,641 | A | 6/1984 | Haas et al. | |
| 4,522,160 | A | 6/1985 | Speers et al. | |
| 4,594,940 | A | 6/1986 | Wolbrink et al. | |
| 4,657,483 | A | 4/1987 | Bede | |
| 4,723,419 | A | 2/1988 | Kessler et al. | |
| 4,858,683 | A | 8/1989 | Beehler | |
| 4,911,234 | A | 3/1990 | Heberer et al. | |
| 4,945,982 | A | 8/1990 | Das | |
| 5,066,194 | A | 11/1991 | Amr et al. | |
| 5,215,437 | A | 6/1993 | TeVelde et al. | |
| 5,248,224 | A | 9/1993 | Amr | |
| 5,307,849 | A * | 5/1994 | Nelson | F24F 1/56 150/165 |
| 5,478,201 | A | 12/1995 | Amr | |
| 5,803,709 | A | 9/1998 | Matthews et al. | |
| 5,879,232 | A | 3/1999 | Luter, II et al. | |
| 5,911,563 | A | 6/1999 | Duppert et al. | |
| 5,951,247 | A | 9/1999 | Rockwell et al. | |
| 5,967,748 | A | 10/1999 | Jang | |
| 6,349,555 | B1 | 2/2002 | Barros et al. | |
| 6,454,527 | B2 | 9/2002 | Nishiyama et al. | |
| 6,777,049 | B2 | 8/2004 | Sheldon et al. | |
| 6,866,474 | B2 | 3/2005 | Uselton | |
| 7,708,052 | B2 | 5/2010 | Leman et al. | |
| 8,267,156 | B2 * | 9/2012 | Wang | F04D 29/526 165/121 |
| 8,413,262 | B2 | 4/2013 | Vito et al. | |
| 8,568,095 | B2 | 10/2013 | Bushnell | |
| 2003/0182954 | A1 | 10/2003 | Parker et al. | |
| 2004/0165986 | A1 | 8/2004 | Parker et al. | |
| 2010/0040458 | A1 | 2/2010 | Bushnell | |
| 2012/0013083 | A1 * | 1/2012 | Pendl | B62B 1/20 280/7.14 |
| 2012/0175089 | A1 | 7/2012 | Choi et al. | |

FOREIGN PATENT DOCUMENTS

| | | | |
|---|---|---|---|
| KR | 20040005798 | A | 1/2004 |
| NL | 8104841 | A | 5/1983 |
| WO | 0027920 | A1 | 5/2000 |

OTHER PUBLICATIONS

Plastic Venturi Blowers, Accessed Dec. 19, 2013, pp. 1-2, http://www.allegrosafety.com/asp/product_detail2013.aspx?prodID=363.

Gas jet fan (Venturi nozzle) of plastic material Type VTD, Mietzsch, Feb. 2004, pp. 1-2, www.mietzsch.de.

M.K.Plastics Corporation, Venturi, Perchloric Acid Exhaust System, Feb. 2009, pp. 1-12, www.mkplastics.com.

* cited by examiner

FIG. 1
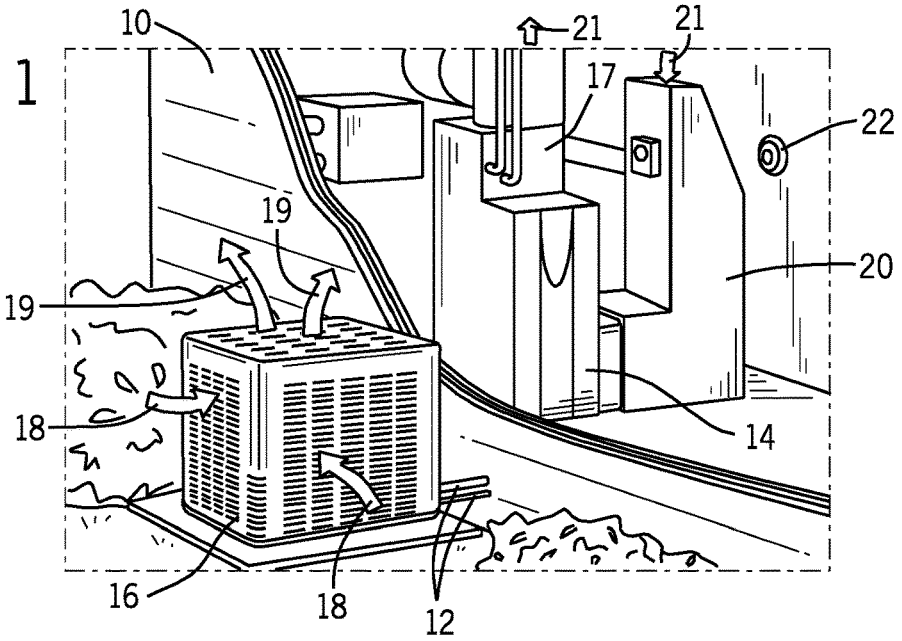
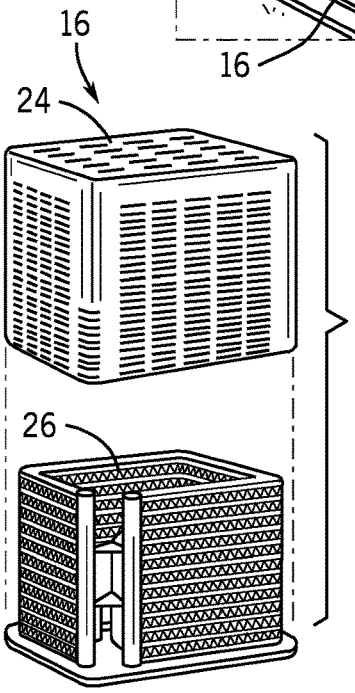
FIG. 2
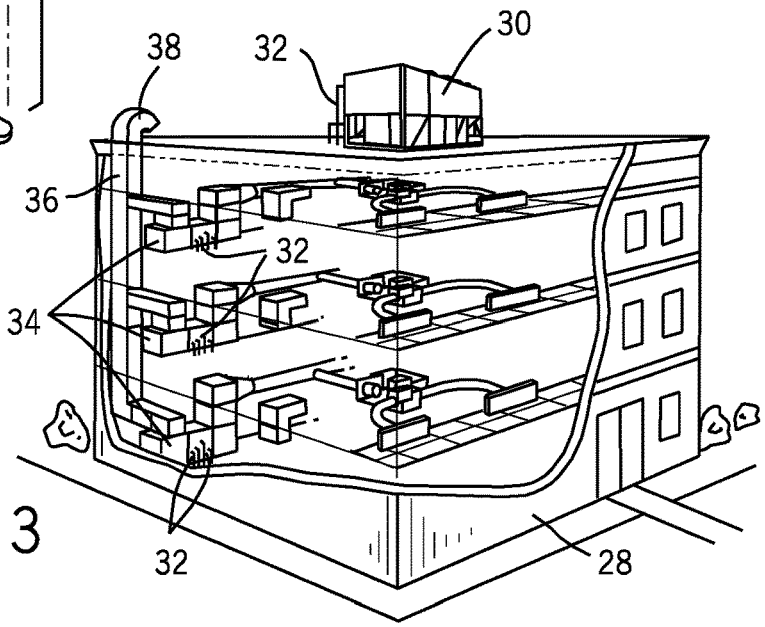
FIG. 3

FOAM SUBSTRUCTURE FOR A HEAT EXCHANGER

CROSS REFERENCE TO RELATED APPLICATIONS

This application claims priority from and the benefit of U.S. Provisional Application Ser. No. 62/279,277, filed Jan. 15, 2016, entitled "FOAM SUBSTRUCTURE FOR A HEAT EXCHANGER," the disclosure of which is hereby incorporated by reference in its entirety for all purposes.

BACKGROUND

The present disclosure relates generally to a foam substructure for a heat exchanger.

Heat exchangers are used in a variety of settings and for many purposes. For example, liquid-to-air heat exchangers are used throughout industry and in many heating, ventilating, air conditioning, and refrigeration applications. The latter applications include residential, commercial, and industrial air conditioning systems in which heat exchangers serve as both condensers and evaporators in a thermal cycle. In general, when used as an evaporator, liquid or primarily liquid refrigerant enters a heat exchanger and is evaporated to draw thermal energy from an air flow stream that is drawn over the heat exchanger coils, tubes, and/or fins. When used as a condenser, the refrigerant enters in a vapor phase (or a mixed phase) and is de-superheated, condensed, and subcooled in the condenser.

In some cases, gaps or openings may be present between a cover and a coil of the heat exchanger, which may reduce efficiency during heat exchanger operation. Accordingly, it is now recognized that it may be desirable to reduce air flow in the gap or opening between the cover and the heat exchanger coil.

DRAWINGS

FIG. 1 is a perspective view of a residential air conditioning or heat pump system that utilizes a heat exchanger, in accordance with an aspect of the present disclosure;

FIG. 2 is a partially exploded view of an outdoor unit of the system of FIG. 1, in accordance with an aspect of the present disclosure;

FIG. 3 is a perspective view of a commercial or industrial system using a heat exchanger and air handlers to cool a building, in accordance with an aspect of the present disclosure;

DETAILED DESCRIPTION

Figure 4:
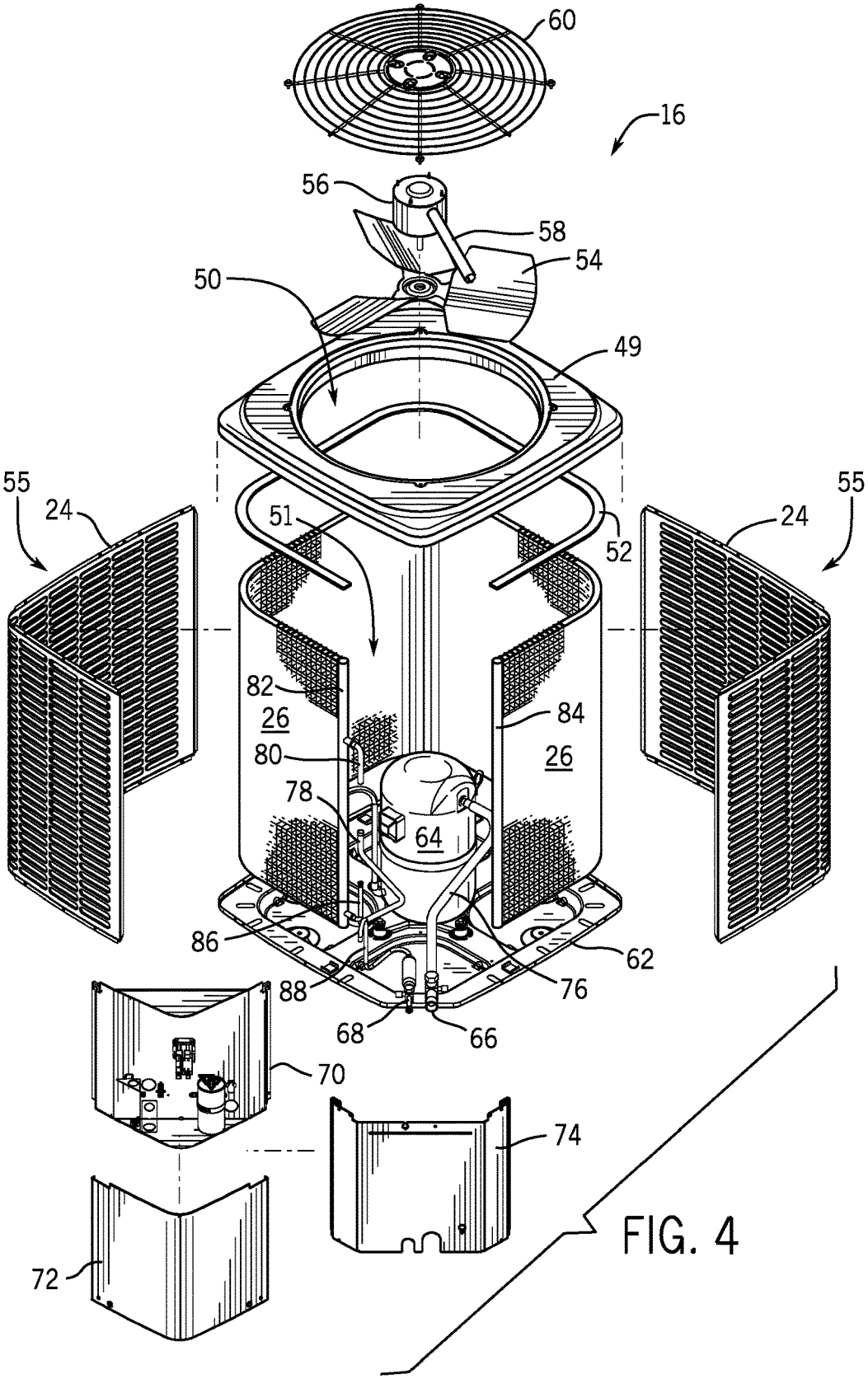
FIG. 4 is an exploded view of the outdoor unit of FIGS. 1 and 2, in accordance with an aspect of the present disclosure.

The present disclosure is directed to a foam substructure for reducing an amount of air flow between a cover and a coil of a heat exchanger. In some cases, a gap or opening between the cover and the heat exchanger coil may decrease efficiency of the heat exchanger because air may be directed and/or trapped in the gap or opening. Accordingly, a fan of the heat exchanger may consume more power to perform a desired amount of heating or cooling. It is now recognized that it may be desirable to at least partially block air flow to the gap or opening between the cover and the heat exchanger coil using a foam substructure. While the present discussion focuses on a foam substructure, in some embodiments the foam substructure may be replaced with a structure or any suitable material for blocking air flow through the gap or opening between the cover and the heat exchanger coil. As used herein, a foam substructure may refer to a structure that includes at least a portion that includes a foam material. For example, the foam substructure may include foam, rubber, plastic, or any combination thereof.

Turning now to the figures, FIGS. 1 through 3 depict exemplary applications for heat exchangers incorporating features in accordance with present embodiments. Such systems, in general, may be applied in a range of settings, both within the heating, ventilating, air conditioning, and refrigeration (HVAC&R) field and outside of that field. In presently contemplated applications, however, heat exchangers may be used in residential, commercial, light industrial, industrial, and/or in any other application for heating or cooling a volume or enclosure, such as a residence, building, structure, and so forth. Moreover, the heat exchangers may be used in industrial applications, where appropriate, for basic refrigeration and heating of various fluids. FIG. 1 illustrates a residential heating and cooling system. In general, a residence 10 may include refrigerant conduits 12 that operatively couple an indoor unit 14 to an outdoor unit 16. The indoor unit 14 may be positioned in a utility room, an attic, a basement, or other location. The outdoor unit 16 is typically situated adjacent to a side of the residence 10 and is covered by a shroud to protect the system components and to block contaminants (e.g., dirt, leaves, rain) from entering the unit 16. The refrigerant conduits 12 may transfer refrigerant between the indoor unit 14 and the outdoor unit 16, typically transferring primarily liquid refrigerant in one direction and primarily vaporized refrigerant in an opposite direction.

When the system shown in FIG. 1 is operating as an air conditioner, a coil in the outdoor unit 16 (e.g., outdoor coil) may serve as a condenser for re-condensing vaporized refrigerant flowing from the indoor unit 14 to the outdoor unit 16 via one of the refrigerant conduits 12. In these applications, an evaporator coil 17 of the indoor unit 14 may receive liquid refrigerant (which may be expanded by an expansion device, not shown) and evaporate the refrigerant before returning it to the outdoor unit 16.

The outdoor unit 16 may draw in ambient air through its sides as indicated by arrows 18 directed to the sides of the unit 16, force the air through the outer unit coil (e.g., outdoor coil) by a means of a fan (not shown), and expel the air as indicated by arrows 19 above the outdoor unit 16. When operating as an air conditioner, the air may be heated by the coil (e.g., outdoor coil) within the outdoor unit 16 and exit the top of the unit 16 at a temperature higher than when it entered the sides. Air may be blown over indoor coil 17 and then circulated through residence 10 by means of ductwork 20, as indicated by arrows 21 entering and exiting the ductwork 20. The overall system operates to maintain a desired temperature as set by a thermostat 22, for example. When the temperature sensed inside the residence is higher than the set point on the thermostat 22 (plus a small amount), the air conditioner may operate to refrigerate additional air for circulation through the residence 10. When the temperature reaches the set point (minus a small amount), the unit 16 may stop the refrigeration cycle temporarily.

When the unit 16 in FIG. 1 operates as a heat pump, the roles of the coils may simply be reversed. That is, the coil of outdoor unit 16 (e.g., outdoor coil) may serve as an evaporator to evaporate refrigerant and thereby cool air entering the outdoor unit 16 as the air passes over the coil of the outdoor unit 16. Additionally, the indoor coil 17 may receive a stream of air blown over it and heat the air by condensing a refrigerant.

FIG. 2 illustrates a partially exploded view of the outdoor unit 16 shown in FIG. 1. In general, the outdoor unit 16 may include an upper assembly made up of a shroud 24, a fan assembly, a fan drive motor, and so forth. In the illustrated embodiment of FIG. 2, the fan and fan drive motor are not visible because they are hidden by the surrounding shroud 24. An outdoor coil 26 is housed within the shroud 24 and may generally surround, or at least partially surround, other system components, such as a compressor, an expansion device, and/or a control circuit.

FIG. 3 illustrates an application of a heating, ventilating, air conditioning, and refrigeration (HVAC&R) system for environmental management of a building 28. For example, the building 28 may be cooled by a system that includes a chiller 30 (e.g., the outdoor unit 16 and/or the indoor unit 14), which is typically disposed on or near the building 28, or in an equipment room or basement. The chiller 30 may be an air-cooled device that implements a refrigeration cycle to cool water, for example. The water (e.g., refrigerant) may then be circulated to the building 28 through water conduits 32. The water conduits 32 may route the water to air handlers 34 at individual floors or sections of the building 28. The air handlers 34 may also be coupled to ductwork 36 adapted to blow air from an outside intake 38.

The chiller 30, which may include heat exchangers for both evaporating and condensing a refrigerant as described above, may cool water (e.g., refrigerant) that is circulated to the air handlers 34. Air blown over additional coils that receive the water in the air handlers 34 may cause the water to increase in temperature and the circulated air to decrease in temperature. The cooled air is then routed to various locations in the building 28 via additional ductwork 36. Ultimately, distribution of the air is routed to diffusers that deliver the cooled air to offices, apartments, hallways, and any other interior spaces within the building 28. In many applications, thermostats or other command devices (not shown in FIG. 3) will serve to control the flow of air through and from the individual air handlers 34 and ductwork 36 to maintain desired temperatures at various locations in the building 28.

FIG. 4 illustrates another partially exploded view of the outdoor unit 16. As shown in the illustrated embodiment, the shroud 24 may have two or more pieces configured to surround the sides of the unit 16 and to protect system components from dirt, rain, leaves, and/or other contaminants. In other embodiments, the shroud 24 may include a single piece configured to be disposed over and around the outdoor coil 26. The outdoor coil 26 may be positioned adjacent to the shroud 24 and a cover 49 may enclose a top portion of the outdoor coil 26. In certain embodiments, the cover 49 may include a venturi orifice 50 configured to direct air flow through a center 51 of the outdoor coil 26. Additionally, a foam substructure 52 may be disposed between the cover 49 and the outdoor coil 26 to block air flow in a void between the cover 49 and the outdoor coil 26. For example, a fan 54 may be located within an opening of the cover 49 and be powered by a motor 56. When operating, the fan 54 may direct air through sides 55 of the outdoor unit 16 and into the center 51 of the outdoor coil 26. A transfer of thermal energy (e.g., heat) may occur between the air and refrigerant that flows through the outdoor coil 26, for example. However, air may flow between the cover 49 and the outdoor coil 26, thereby reducing an amount of thermal energy transferred. Accordingly, the fan 54 may utilize more power to account for the air that bypasses the center 51 of the outdoor coil 26. Therefore, the foam substructure 52 may be utilized to block air from flowing into a void between the cover 49 and the outdoor coil 26, such that more air may contact the outdoor coil 26 and undergo thermal energy transfer with the refrigerant flowing through the outdoor coil 26.

Additionally, a wire way 58 may be used to connect the motor 56 to a power source to operate the fan 54. A fan guard 60 may be disposed within the cover 49 and above the fan 54 to block objects (e.g., contaminants) from entering and/or contacting the fan 54. In certain embodiments, the outdoor coil 26 may be mounted on a base pan 62. The base pan 62 may provide a mounting surface and structure for the internal components of the outdoor unit 16. A compressor 64 may be disposed within the center of the unit 16 and be connected to another unit within the HVAC&R system, for example the indoor unit 14, by connections 66 and 68. The connections 66 and 68 may be configured to connect the outdoor unit 16 to conduits circulating refrigerant within the HVAC&R system. Additionally, a control box 70 may house control circuitry for the outdoor unit 16 and be protected by a cover 72. As shown in the illustrated embodiment of FIG. 4, a panel 74 may be used to mount the control box 70 to the outdoor unit 16.

Vaporous refrigerant may enter the unit 16 through the connection 66 and flow through a conduit 76 into the compressor 64. In certain embodiments, the vaporous refrigerant may be received from the indoor unit 14 (not shown). After undergoing compression in the compressor 64, the refrigerant may exit the compressor 64 through a conduit 78 and enter the outdoor coil 26 through inlet 80. The inlet 80 may direct the refrigerant into a first header 82 (e.g., a first manifold). From the first header 82, the refrigerant may flow through the outdoor coil 26 to a second header 84 (e.g., a second manifold). From the second header 84, the refrigerant may flow back through the outdoor coil 26 and exit through an outlet 86 disposed on the first header 82. After exiting the outdoor coil 26, the refrigerant may flow through conduit 88 to connection 68 to return to the indoor unit 14, for example, where the process may begin again. It should be noted, that while the illustrated embodiment of FIG. 4 shows the inlet 80 and the outlet 86 located on the first header 82, the inlet 80 and/or the outlet 86 may be positioned on the second header 84.

As discussed above, gaps, voids, and/or openings between the cover 49 and the outdoor coil 26 may be undesirable because air may bypass the center 51 of the outdoor coil 26 and flow into the gap. Accordingly, an amount of thermal energy transfer between the air and the refrigerant in the outdoor coil 26 may be reduced. For example, when the outdoor coil 26 acts as a condenser, air is directed through the center 51 of the outdoor coil 26 to cool refrigerant flowing within the outdoor coil 26. Therefore, when air bypasses the center 51 of the outdoor coil 26 and into the gap, void, or opening, the outdoor unit 16 may become less efficient as a result of the fan 54 consuming more power to reduce a temperature of the refrigerant to a desired level. Similarly, when the outdoor coil 26 acts as an evaporator, air that bypasses the center 51 of the outdoor coil 26 may cause the fan 54 to consume more power to increase a temperature of the refrigerant to a desired level. Accordingly, it is now recognized that the foam substructure 52 may include various configurations that may minimize air flow in the gap, void, and/or opening between the cover 49 and the outdoor coil 26, and thus force air flow across the outdoor coil 26 to the center 51 of the coil 26, thereby increasing an efficiency of the outdoor unit 16.

Figure 5:
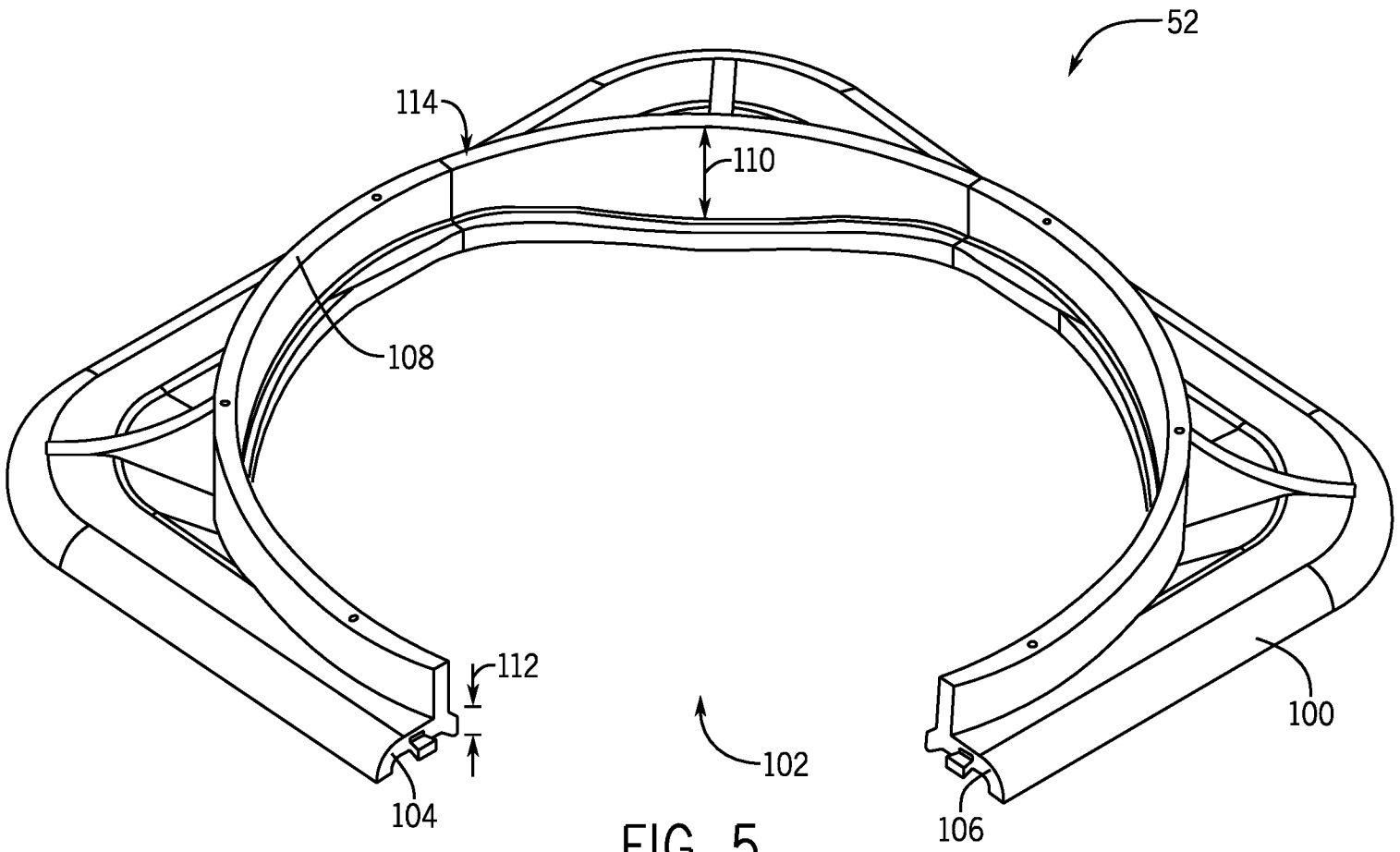
FIG. 5 is perspective view of an embodiment of a foam substructure, in accordance with an aspect of the present disclosure.

For example, FIG. 5 is perspective view of the foam substructure 52. As shown in the illustrated embodiment of FIG. 5, the foam substructure 52 includes a base 100 having partial rectangular (or square) shape that has an opening 102 between a first end 104 and a second end 106. For example, the outdoor coil 26 shown in FIGS. 2 and 4 includes a similar substantially rectangular shape that also includes an opening. Therefore, the opening 102 of the foam substructure 52 may be configured to correspond to the opening of the outdoor coil 26. Additionally, the shape of the foam substructure 52 may be configured to be substantially equivalent to the shape of the outdoor coil 26. Accordingly, the base 100 of the foam substructure 52 may be positioned along a top surface of the outdoor coil 26. The ends 104, 106 of the foam substructure 52 may be substantially aligned with a first end of the outdoor coil 26 and a second end of the outdoor coil 26, respectively. For example, the ends 104, 106 may be positioned on the outdoor coil 26 and adjacent to the headers 82, 84. In other embodiments, the ends 104, 106 may be aligned with (e.g., disposed on a top surface of) the headers 82, 84. In still further embodiments, the ends 104, 106 may be positioned any suitable distance from the headers 82, 84 to substantially fill the gap, void, and/or opening between the cover 49 and the outdoor coil 26.

Additionally, the foam substructure 52 may include an inner ring 108. The inner ring 108 may include a substantially circular shape and may have a height 110 that is greater than a height 112 of the base 100. The height 110 of the inner ring 108 may enable the base 100 of the foam substructure 52 to contact the outdoor coil 26 and enable a top edge 114 of the inner ring 108 to contact the cover 49 (e.g., the venturi orifice 50). As such, the foam substructure 52 may support the cover 49 as well as at least partially fill the gap between the cover 49 and the outdoor coil 26. In certain embodiments, the base 100 and the inner ring 108 may be configured to include a cross-section that is substantially similar to a cross section of the void between the cover 49 and the outdoor coil 26. Accordingly, the foam substructure 52 may conform to the cross-section of the void and block air from flowing into and/or through the void.

In certain embodiments, the base 100 and the inner ring 108 may be formed from a single mold (e.g., an injection mold). In other embodiments, the base 100 and the inner ring 108 may be separate components that are secured to one another via fasteners (e.g., screws, bolts, rivets), an adhesive (e.g., glue, epoxy, or tape), friction fit interfaces, interlocking geometries, and/or any other suitable coupling feature and/or fasteners (e.g., screws, bolts, rivets).

Figure 6:
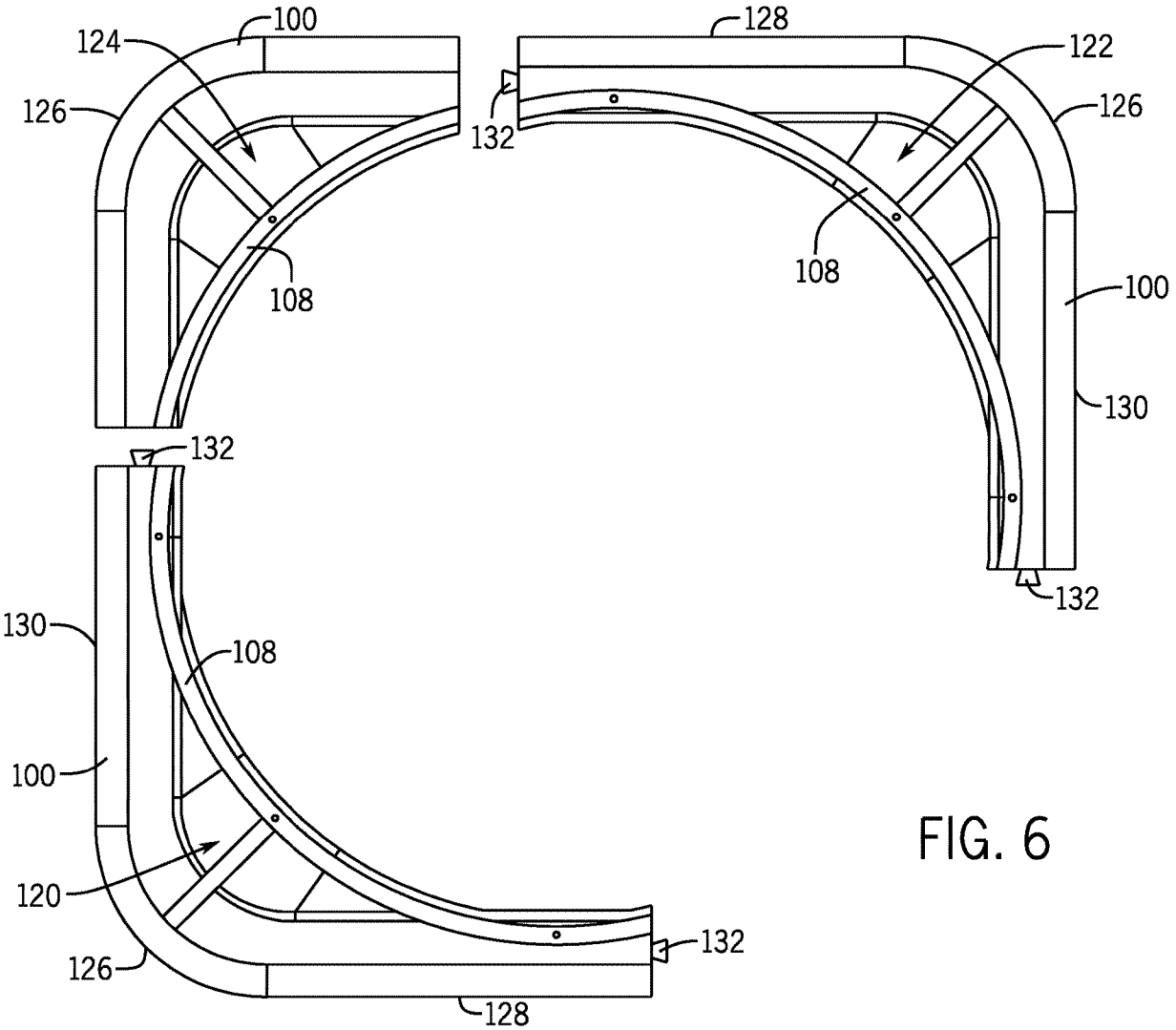
FIG. 6 is a plan view of sections of an embodiment of the foam substructure of FIG. 5, in accordance with an aspect of the present disclosure.

For example, FIG. 6 is a plan view of sections of the foam substructure 52 of FIG. 5. As shown in the illustrated embodiment, the foam substructure 52 includes a first end piece 120, a second end piece 122, and a center piece 124. In certain embodiments, the first end piece 120 and the second end piece 122 may be substantially the same (e.g., formed from the same injection mold). In other embodiments, the first end piece 120 and the second end piece 122 may be different from one another, such that two different injection molds may be used to form the first end piece 120 and the second end piece 122.

In certain embodiments, the first end piece 120 and/or the second end piece 122 may include a corner portion 126, a first arm 128, and a second arm 130. The corner portion 126 may be configured to fit with or around a corner of the outdoor coil 26. For example, the outdoor coil 26 may include a partial square or rectangle shape, such that a cross-section of the outdoor coil 26 includes rounded corners (e.g., 3 rounded corners). Additionally, the first arm 128 and/or the second arm 130 may be utilized to couple the components 120, 122, and 124 of the foam substructure 52 to one another. For example, in the illustrated embodiment of FIG. 6, the first arm 128 and the second arm 130 of both the first end piece 120 and the second end piece 122 each include an extension member 132 configured to be received (e.g., secured) by the center piece 124. Therefore, the center piece 124 may include corresponding notches (e.g., indentations, grooves, slots, slits) that are configured to receive and secure the extension members 132 such that the first end piece 120 couples to the center piece 124 and/or the second end piece 122 couples to the center piece 124. In other embodiments, the center piece 124 may include the extension members 132 and the first end piece 120 and/or the second end piece 122 may include the notches. In still further embodiments, the center piece 124 may include extension members 132 and/or the notches, and the first end piece 120 and/or the second end piece 122 may include the extension members 132 and/or the notches as well. Additionally, the components 120, 122, and 124 of the foam substructure 52 may not include the notches and/or the extension members 132, but rather be coupled to one another via fasteners (e.g., screws, bolts, rivets), adhesives (e.g., glue, epoxy, tape), or other coupling feature.

In certain embodiments, the center piece 124 may be substantially shorter than the first end piece 120 and/or the second end piece 122. For example, the center piece 124 may include the corner portion 126, but not the first arm 128 and/or the second arm 130. The first end piece 120, the second end piece 122, and the center piece 124 may be configured to form the base 100 into a shape that is substantially similar to a shape of the outdoor coil 26.

Additionally, the first end piece 120, the second end piece 122, and the center piece 124 may be configured to form the inner ring 108. In certain embodiments, the inner ring 108 may be in substantial or general alignment with the venturi orifice 50 of the cover 49. For example, air may be drawn through the sides 55 of the outdoor unit 16, through the center 51 of the outdoor coil 26, through the venturi orifice 50, and out a top end of the outdoor unit 16. Accordingly, the air may be used to heat or cool refrigerant flowing through the outdoor coil 26. In certain cases, however, a void between the venturi orifice 50 of the cover 49 and the outdoor coil 26 may receive air flow, thereby preventing such air from flowing through the center 51 of the outdoor coil 26 and cooling and/or heating the refrigerant. Accordingly, the motor 54 may use more power to perform a desired amount of heating or cooling of the refrigerant as a result of the air bypassing the venturi orifice 50.

Figure 7:
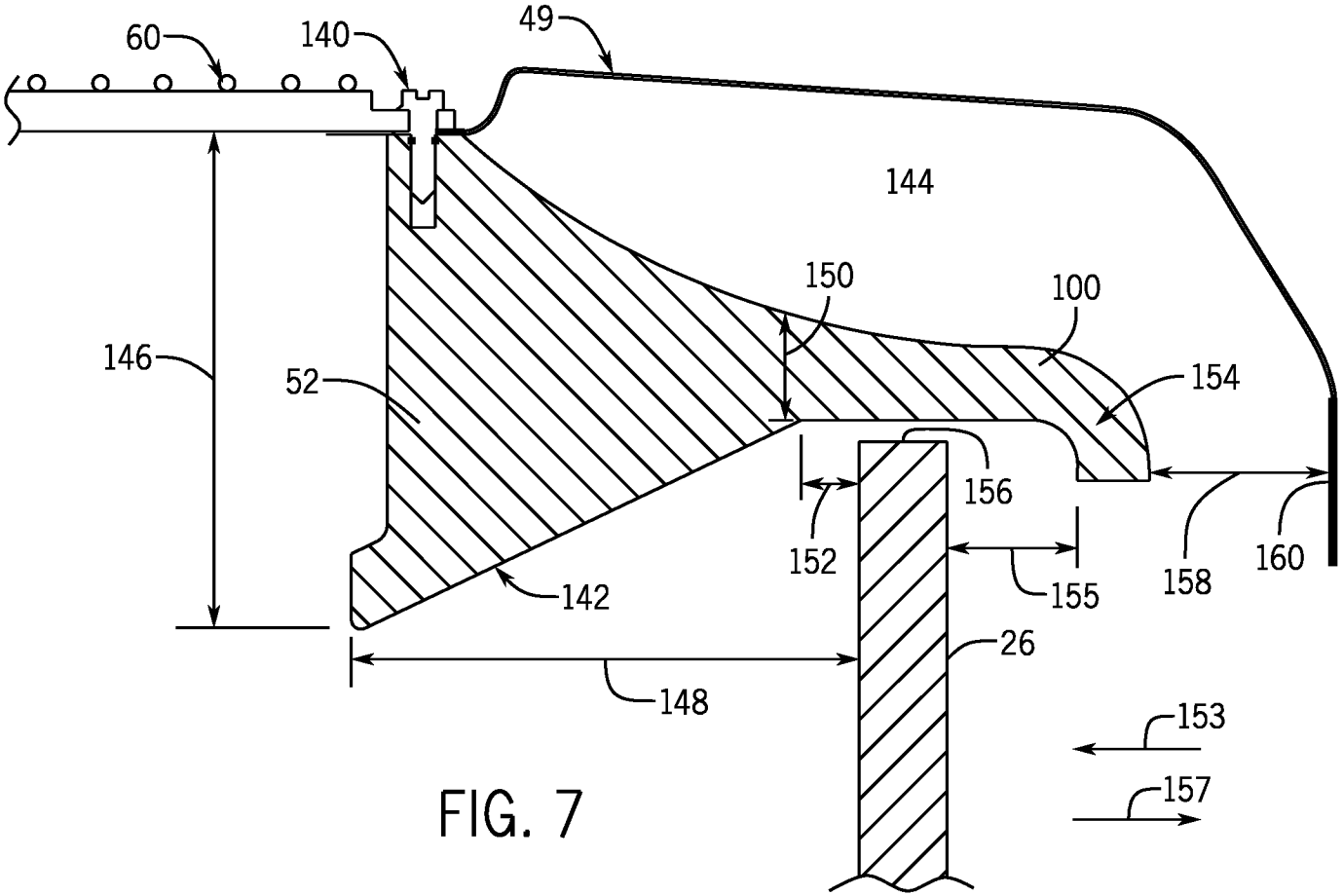
FIG. 7 is a cross section of an embodiment of the foam substructure of FIGS. 5 and 6, in accordance with an aspect of the present disclosure.

It is now recognized that utilizing the foam substructure 52 having configurations consistent with present embodiments may block air from flowing into the void between the venturi orifice 50 of the cover 49 and the outdoor coil 26. For example, FIG. 7 is a cross section of the foam substructure 52 of FIGS. 5 and 6 positioned between the cover 49 and the outdoor coil 26. As shown in the illustrated embodiment, the foam substructure 52 may be coupled to the cover 49 via a fastener 140. The fastener 140 may be a screw, a bolt, a rivet, or any other device configured to couple the cover 49 to the foam substructure 52. Additionally, the fastener 140 may also couple the foam substructure 52 to the fan guard 60 such that the fan guard 60, the cover 49, and the foam substructure 52 may be secured to one another.

As shown in the illustrated embodiment of FIG. 7, the base 100 of the foam substructure 52 may include a sloped surface 142. In certain embodiments, the sloped surface 142 may be configured to prevent air flow from entering a void 144 between the cover 49 and the outdoor coil 26. For example, the sloped surface 142 may enable the base 100 of the foam substructure 52 to have a first height 146 a first distance 148 from the outdoor coil 26. Additionally, the sloped surface 142 may enable the base 100 to have a second height 150, which is less than the first height 146, a second distance 152 from the outdoor coil 26, which is less than the first distance 148. Therefore, as the distance between the sloped surface 142 of the foam substructure 52 and the outdoor coil 26 decreases, the height of the foam substructure 52 may also decrease to block air from flowing between the outdoor coil 26 and the cover 49. The sloped surface 142 may also at least partially block movement of the foam substructure 52 to the outdoor coil 52 in a first direction 153. For example, the sloped surface 142 may prevent misalignment of the foam substructure 52 and the outdoor coil 26 by providing resistance to movement in the first direction 153.

In certain embodiments, the foam substructure 52 may include a lipped portion 154 that may surround and/or seal a top surface 156 of the outdoor coil 26 and reduce air flow between the foam substructure 52 and the outdoor coil 26. In other words, the lipped portion 154 may at least partially seal the foam substructure 52 over the outdoor coil 26 to block air flow between the cover 49 and the outdoor coil 26 such that more air may be directed through the outdoor coil 26 and an efficiency of the outdoor unit 16 may be increased. Additionally, the lipped portion 154, either alone or in combination with the sloped surface 142, may at least partially secure the foam substructure 52 to the outdoor coil 26. For example, the lipped portion 154 may reduce misalignment of the foam substructure 52 and the outdoor coil 26 by blocking movement of the outdoor coil 26 in a second direction 157. In certain embodiments, the lipped portion 154 may extend a distance 155 past the outdoor coil 26 such that the foam substructure 52 may be further secured to the outdoor coil 26 and to ensure that air flow between the outdoor coil 25 and the cover 49 is blocked.

Figure 8:
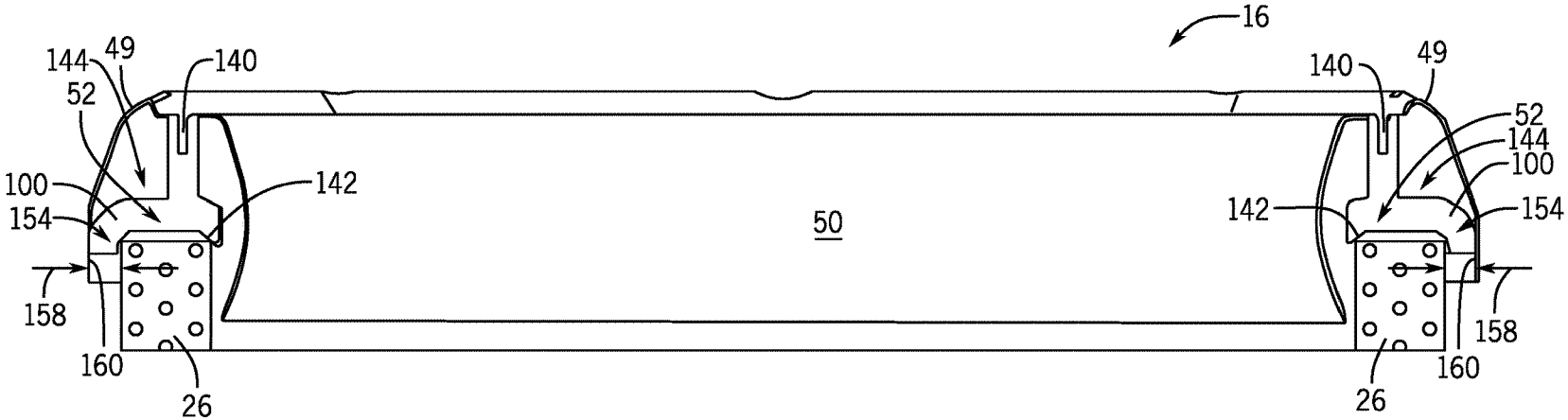
FIG. 8 is a cross-section of an embodiment of the foam substructure, in accordance with an aspect of the present disclosure.

As shown in the illustrated embodiment of FIG. 7, a gap 158 may be formed between the lipped portion 154 and a vertical surface 160 (e.g., vertical with respect to the base pan 62) of the cover 49. In certain embodiments, the distance 155 that the lipped portion 154 extends from the outdoor coil 26 may also reduce a size of the gap 158. However, in other embodiments, the foam substructure 52 may be configured to eliminate or close the gap 158. For example, FIG. 8 is a cross-section of another embodiment of the foam substructure 52 where the lipped portion 154 is proximate to the vertical surface 160 such that the gap 158 is substantially or generally eliminated. The embodiment shown in FIG. 8 may be configured to block air flow between the cover 49 and the outdoor coil 26 for an outdoor unit 16 that includes a venturi orifice 50 with a relatively large diameter. For instance, the embodiment of the foam substructure 52 of FIG. 7 includes a wider base 100 than the embodiment of FIG. 8, which may account for a venturi orifice 50 having a smaller diameter. In other words, as a distance between the venturi orifice 50 and the outdoor coil 26 increases, the width the base 100 of the foam substructure may also increase to block air flow into the void 144 between the cover 49 and the outdoor coil 26.

Accordingly, the sloped surface 142 of the foam substructure 52 of FIG. 8 may not extend as far from the outdoor coil 26 as the sloped surface 142 of the embodiment shown in FIG. 7 because of the decreased distance between the venturi orifice 50 and the outdoor coil 26. In other embodiments, however, the sloped surface 142 may extend any suitable distance from the outdoor coil 26 to substantially block air from flowing between the outdoor coil 26 and the cover 49.

Additionally, the lipped portion 154 of the foam substructure of FIG. 8 substantially fills the gap 158 between the outdoor coil 26 and the vertical surface 160 of the cover 49. Therefore, if air were to flow between the outdoor coil 26 and the cover 49, the air may be blocked from completely flowing outside of the outdoor unit 16 (e.g., via the gap 158 between the outdoor coil 26 and the vertical surface 160 of the cover 49). Accordingly, the air may eventually be directed toward the center 51 of the outdoor coil 26, rather than exiting the outdoor unit 16 altogether.

In certain embodiments, the fastener 140 may secure the foam substructure 52 to the cover 49. For example, the fastener 140 may be a separate component (e.g., a screw, a bolt, a rivet) configured to couple the foam substructure 52 to the cover 49. In other embodiments, the fastener 140 may be integrated with the cover 49. For example, the fastener 140 may be a protrusion or an extension formed in the cover 49 that may be inserted into a corresponding opening in the foam substructure 52 to secure the cover 49 to the foam substructure 52. As discussed above, the foam substructure 52 may also be at least partially secured to the outdoor coil 26 via the sloped surface 142 and the lipped portion 154. However, in other embodiments, the base 100 of the foam substructure 52 may include a clamp or other coupling feature (e.g., an integrated clamping geometry) to further secure the foam substructure 52 to the outdoor coil.

Figure 9:
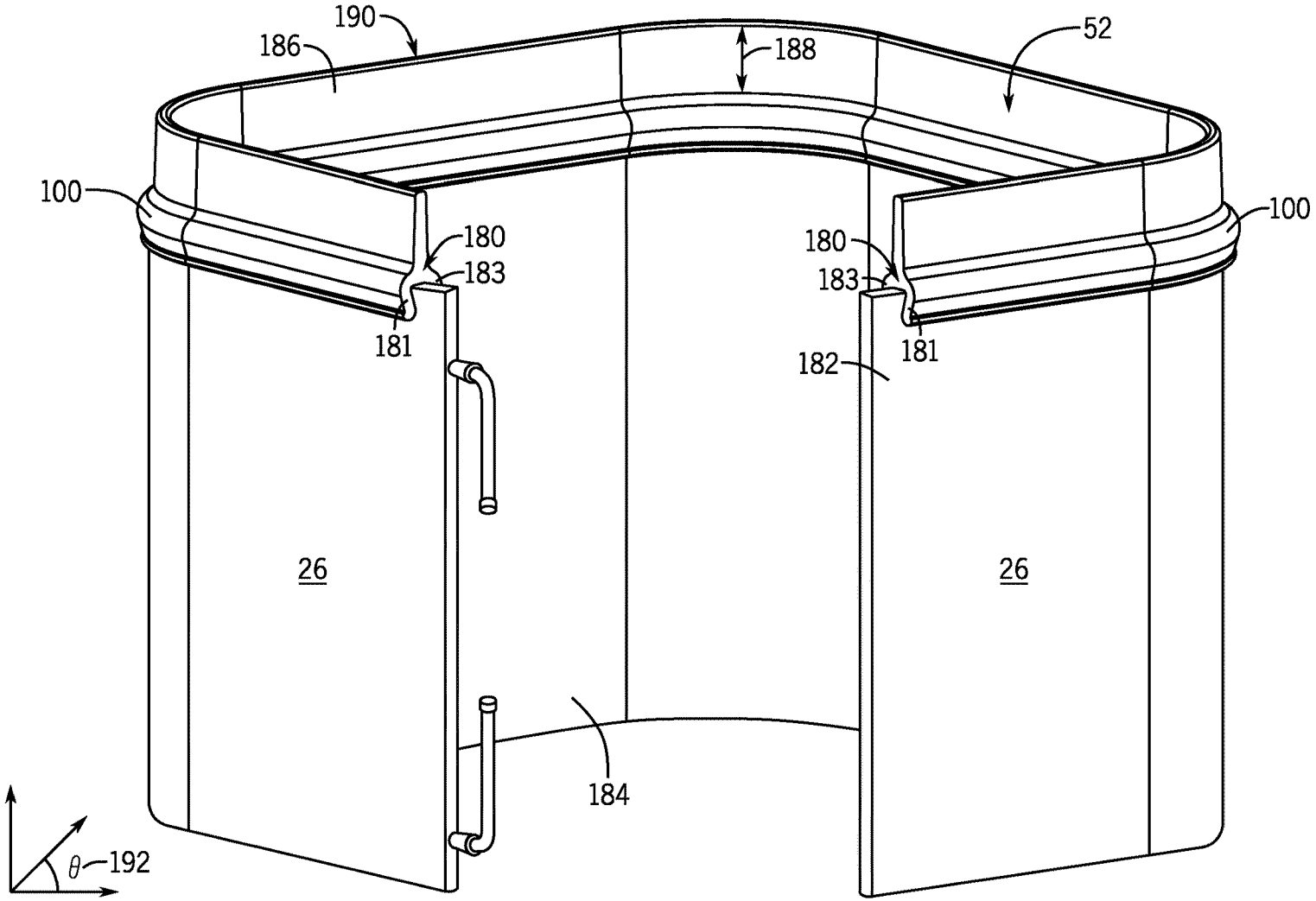
FIG. 9 is a perspective view of an embodiment of the foam substructure coupled to a heat exchanger coil, in accordance with an aspect of the present disclosure.

For example, FIG. 9 is a perspective view of an embodiment of the foam substructure 52 where the base 100 includes a clamp 180 that may enable the foam substructure 52 to be secured to the outdoor coil 26. As shown in the illustrated embodiment of FIG. 9, the clamp 180 (e.g., an integrated clamping geometry) may apply a clamping force to the outdoor coil 26. For example, a first arm 181 of the clamp 180 may exert a biasing force toward a first surface 182 of the outdoor coil 26 and a second arm 183 of the clamp 180 may exert a biasing force toward a second surface 184 of the outdoor coil 26. Accordingly, the foam substructure 52 may be secured to the outdoor coil 26 without utilizing additional fasteners (e.g., screws, bolts, rivets).

The illustrated embodiment of FIG. 9 shows the foam substructure 52 having a vertical member 186 (e.g., generally 90 degrees with respect to the base pan 62). In certain embodiments, the vertical member 186 may form an angle with respect to the base 100 between 80 degrees and 110 degrees. The vertical member 186 may enable the foam substructure 52 to extend a height 188 above the outdoor coil 26 such that the cover 49 may not contact or otherwise damage the outdoor coil 26 as a result of contact between the cover 49 and the outdoor coil 26. Therefore, the foam substructure 52 may provide a buffer between the outdoor coil 26 and the cover 49. Further, the vertical member 186 of the cover 49 may couple to the cover 49 (e.g., foam substructure 54 indirectly couples the cover 49 to the outdoor coil 26). For example, the cover 49 may be coupled to the vertical member 186 via a fastener (e.g., a screw, a bolt, a rivet), an adhesive (e.g., glue, epoxy, tape), and interference fit, interlocking geometries, and/or any other suitable coupling feature.

As shown in the illustrated embodiment, the vertical member 186 includes substantially the same shape as the base 100 along a top surface of the outdoor coil 26. For example, the base 100 and the vertical member 186 include substantially the same shape (e.g., a square or rectangular shape) as the outdoor coil 26. Conversely, the inner ring 108 of the foam substructure 52 of FIGS. 5-7 may include a shape that is substantially similar to the venturi orifice 50 (e.g., a circle shape). Accordingly, the foam substructure 52 illustrated in FIG. 9 may be utilized when a distance between the venturi orifice 50 and the outdoor coil 26 is relatively small (e.g., the foam substructure 52 may not fill a void or gap between the venturi orifice 50 and the outdoor coil 26). In other embodiments, the vertical member 186 may be offset from the base 100 such that it may include a shape substantially similar to that of the venturi orifice 50. In still further embodiments, the vertical member 186 may be angled toward the venturi orifice 50 with respect to the base 100 such that a top surface 190 the vertical member 186 may be closer to the venturi orifice 50 than the base 100. In other words, an angle 192 between the vertical member 186 and the base 100 may be greater than or less than 90 degrees. For example, the angle 192 may be between 30 degrees and 150 degrees, between 45 degrees and 135 degrees, between 60 degrees and 120 degrees, or any combination thereof.

Figure 10:
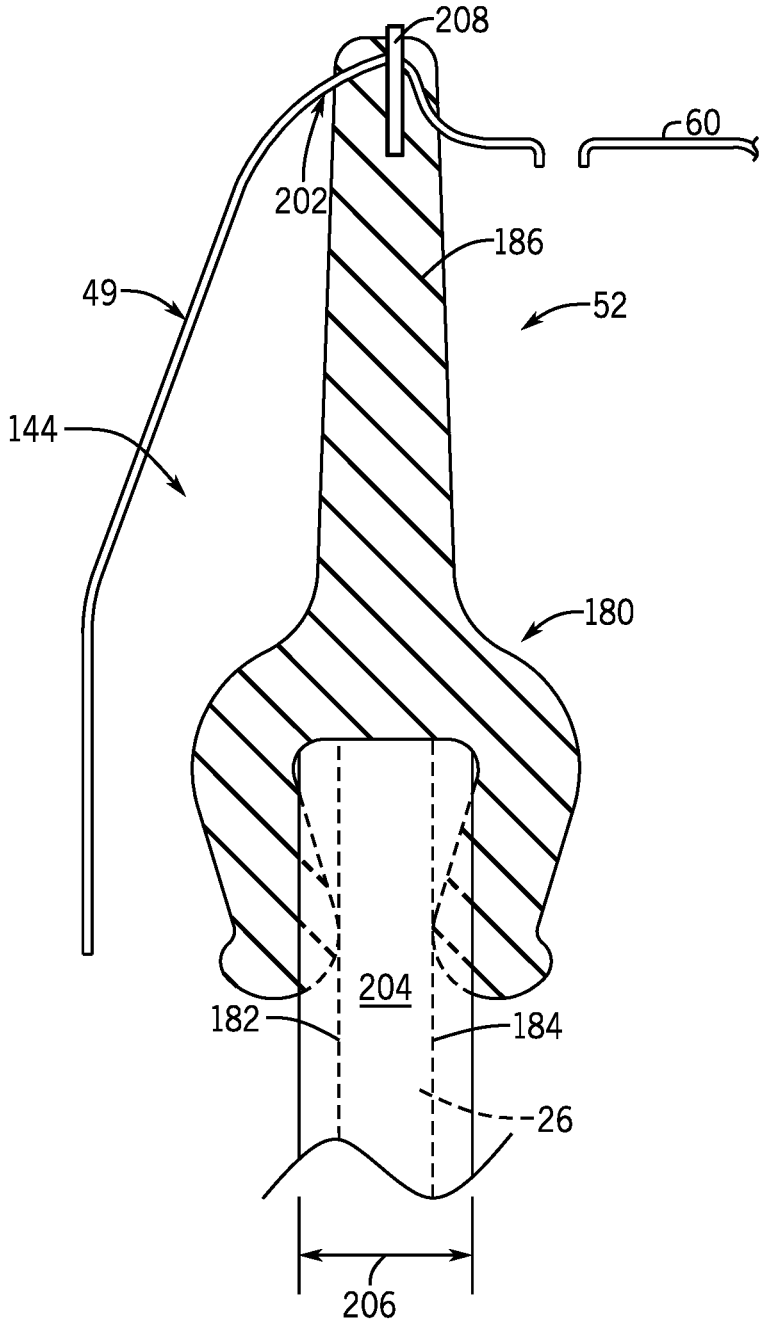
FIG. 10 is a cross section of an embodiment of the foam substructure of FIG. 9, in accordance with an aspect of the present disclosure.

As discussed above, the foam substructure 52 may be coupled to the cover 49 and configured to block air from flowing between the outdoor coil 26 and the cover 49. For example, FIG. 10 is a cross section of the foam substructure of FIG. 9 coupled to the cover 49 and exerting a clamping force against the outdoor coil 26. As shown in the illustrated embodiment of FIG. 10, the clamp 180 of the foam substructure 52 includes the first arm 181 and the second arm 183. As discussed above, the first arm 181 may exert a biasing force toward the first surface 182 of the outdoor coil 26 and the second arm 183 may exert a biasing force toward the second surface 184 of the outdoor coil 26. Therefore, the first and second arms 181, 183 provide a clamping force against the outdoor coil 26 such that the foam substructure 52 may be at least partially secured to the outdoor coil 26.

Additionally, the illustrated embodiment of FIG. 10 includes a header 204 of the outdoor coil 26. In certain embodiments, the header 204 may include a rectangular cross section (e.g., as shown in FIG. 10). The rectangular cross section may include a width 206 greater than a width of the outdoor coil 26; however the foam substructure 52 may not extend to the header 204, such that the first and second arms 181, 183 are in contact with the first and second surfaces 182, 184 of the outdoor coil 26. In other embodiments, the foam substructure 52 may be configured to extend to the header 204 such that the clamp 180 engages and/or conforms to the header 204 as well as to the outdoor coil 26.

Further, the vertical member 186 may be secured to the cover 49 via a fastener 208. The fastener 208 may be a screw, a bolt, a rivet, or another device configured to couple the foam substructure 52 (e.g., via the vertical member 186) to the cover 49. As shown in the illustrated embodiment of FIG. 10, the foam substructure 52 completely fills the void 144 between the cover 49 and the outdoor coil 26 that may enable air to escape when flowing through the outdoor unit 16. Accordingly, the foam substructure 52 may block air from flowing through such void and direct the air to flow across the outdoor coil 26 and out of the outdoor unit 16 through the fan guard 60. The foam substructure 52 may thus increase an efficiency of the outdoor unit 16 by reducing an amount of power consumed by the fan 54 and also increase a heat transfer efficiency of the outdoor coil 26.

In certain embodiments, the foam substructure 52 may include a material that includes compliant properties (e.g., foam, rubber, plastic). As shown in the illustrated embodiment of FIG. 10, an interference fit may be utilized between the foam substructure 52 and the cover 49 to create a seal, thereby blocking air from flowing through the void 144 between the cover 49 and the outdoor coil 26. For example, the cover 49 may be disposed over the foam substructure 52 and compress the foam substructure 52 against the cover 49, thereby forming a seal as the foam substructure 52 conforms to a surface 202 of the cover 49. Additionally, the compliant qualities of the foam substructure 52 may enable greater engineering tolerances of the foam substructure 52 and/or the cover 49 during manufacturing. For example, exact construction specifications and/or measurements may not be followed, but the seal may still form between the foam substructure 52 and the cover 49 as a result of the interference fit and the compliant properties of the foam substructure 52.

Figure 11:
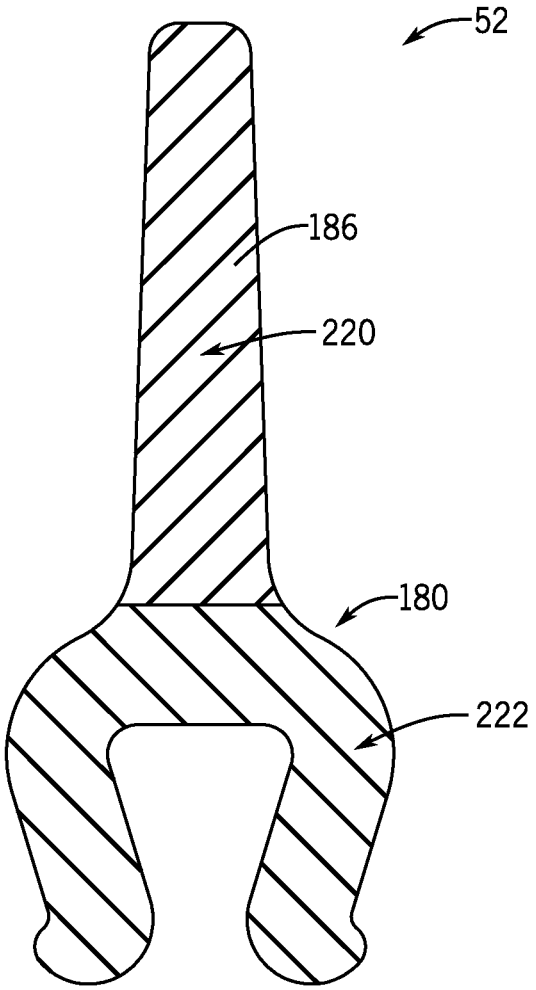
FIG. 11 is a cross section of the foam substructure of FIGS. 9 and 10 having different materials, in accordance with an aspect of the present disclosure.

In some embodiments, the foam substructure 52 may include more than one material. For example, it may be desirable that the vertical member 186 include a first material having compliant properties (e.g., foam) and that the clamp 180 may include a second material (e.g., rubber or plastic) that to facilitate a secure connection between the foam substructure 52 and the outdoor coil 26. For example, FIG. 11 is a cross-section of the foam substructure 52 where the vertical member 186 includes a compliant material 220 (e.g., a first material) and the clamp 180 of the base 100 includes a relatively rigid material 222 (e.g., a second material). In certain embodiments, the rigid material 222 of the clamp 180 may include rubber, plastic, or a combination thereof. The rigid material 222 may provide a sufficient biasing force toward the first surface 182 of the outdoor coil and the second surface of the outdoor coil 184. However, the rigid material 222 may not be compliant, such that it may not conform to the void 144 between the cover 49 and the outdoor coil 26. Therefore, the vertical member 186 may include the compliant material 220, which may be more suitable for blocking air from flowing between the cover 49 and the outdoor coil. In certain embodiments, the compliant material 220 may be foam or any other suitable material that may conform to the void 144 between the cover 49 and the outdoor coil 26. In other embodiments, the foam substructure 52 may include a single material. In still further embodiments, the foam substructure 52 may include more than two materials (e.g., 3, 4, 5, 6, 7, 8, 9, 10, or more).

One or more of the disclosed embodiments, alone or in combination, may provide one or more technical effects useful in the manufacture and operation of heat exchangers. In general, embodiments of the present disclosure include a foam substructure that may be disposed between an outdoor coil of an outdoor unit and a cover of the outdoor unit. The foam substructure may block air flow from escaping between the outdoor coil and the cover, such that an enhanced amount of air may flow through a venture orifice located in a center of the outdoor coil. As such, the enhanced amount of air flowing through the venture orifice may maximize an amount of heat transfer, thereby enhancing an efficiency of the outdoor unit. The technical effects and technical problems in the specification are exemplary and are not limiting. It should be noted that the embodiments described in the specification may have other technical effects and can solve other technical problems.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or resequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out an embodiment, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilating, air-conditioning, and/or refrigeration (HVAC&R) system, comprising:

a foam substructure disposed between a heat exchanger coil and a cover of a heat exchanger, wherein the foam substructure comprises:

a base comprising a sloped surface and a lipped portion extending from the sloped surface, wherein the base is configured to be positioned proximate to the heat exchanger coil, the base has a first shape configured to at least partially conform to a second shape of the heat exchanger coil, and the sloped surface and the lipped portion are configured to block air from flowing between the heat exchanger coil and the cover of the heat exchanger; and an inner ring extending from the base and configured to be coupled to the cover of the heat exchanger.

2. The HVAC&R system of claim 1, wherein the base comprises foam and the inner ring comprises rubber.

3. The HVAC&R system of claim 1, wherein the sloped surface comprises a first height a first distance from the heat exchanger coil and a second height a second distance from the heat exchanger coil, wherein the first height is greater than the second height and the first distance is greater than the second distance.

4. The HVAC&R system of claim 1, wherein the base and the inner ring are formed from a single piece.

5. The HVAC&R system of claim 1, wherein the base and the inner ring are integrated into multiple pieces configured to couple to one another.

6. The HVAC&R system of claim 5, wherein the multiple pieces comprise a first end piece, a second end piece, and a center piece.

7. The HVAC&R system of claim 6, wherein the first end piece and the second end piece each comprise an extension member configured to be received by a corresponding notch in the center piece.

8. The HVAC&R system of claim 1, wherein the lipped portion is configured to contact a vertical surface of the cover of the heat exchanger.

9. The HVAC&R system of claim 1, wherein the inner ring is configured to couple to the cover of the heat exchanger via a fastener.

* * * * *